US007826631B2

(12) United States Patent
Fischer et al.

(10) Patent No.: US 7,826,631 B2
(45) Date of Patent: Nov. 2, 2010

(54) HEARING AID WITH AUTOMATIC SOUND STORAGE AND CORRESPONDING METHOD

(75) Inventors: Eghart Fischer, Schwabach (DE); Uwe Rass, Nürnberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1281 days.

(21) Appl. No.: 11/365,402

(22) Filed: Mar. 1, 2006

(65) Prior Publication Data

US 2006/0198530 A1 Sep. 7, 2006

(30) Foreign Application Priority Data

Mar. 2, 2005 (DE) ..... 10 2005 009 530

(51) Int. Cl.
*H04R 25/00* (2006.01)

(52) U.S. Cl. ..... 381/312; 381/314; 381/315; 381/317

(58) Field of Classification Search ..... 381/312, 381/314, 315, 317, 318, 320
See application file for complete search history.

(56) References Cited

U.S. PATENT DOCUMENTS

| | | | | |
|---|---|---|---|---|
| 5,202,927 A | | 4/1993 | Topholm | |
| 5,604,812 A | * | 2/1997 | Meyer | 381/314 |
| 6,035,050 A | | 3/2000 | Weinfurtner et al. | |
| 7,117,429 B2 | | 10/2006 | Vedullapalli et al. | |
| 7,738,667 B2 | * | 6/2010 | Bramslow et al. | 381/317 |
| 2002/0037087 A1 | * | 3/2002 | Allegro et al. | 381/317 |
| 2003/0112988 A1 | | 6/2003 | Naylor | |
| 2004/0213424 A1 | | 10/2004 | Hamacher et al. | |
| 2006/0215860 A1 | | 9/2006 | Wyrsch | |

FOREIGN PATENT DOCUMENTS

| | | | |
|---|---|---|---|
| AU | 2003281984 | A1 | 12/2003 |
| DE | 10152197 | A1 | 5/2003 |
| EP | 0453450 | B1 | 10/1991 |
| EP | 0335542 | B1 | 12/1994 |
| EP | 0814634 | B1 | 12/1997 |
| EP | 1 453 356 | A2 | 9/2004 |
| EP | 1256258 | B1 | 3/2005 |
| WO | WO 2004/056154 | A2 | 7/2004 |
| WO | WO 2005/051039 | A1 | 6/2005 |

* cited by examiner

*Primary Examiner*—Suhan Ni
*Assistant Examiner*—Jasmine Pritchard
(74) *Attorney, Agent, or Firm*—Schiff Hardin LLP

(57) ABSTRACT

The adaptation of a hearing aid to the wearer is made more convenient according to a hearing aid and method of use. A hearing situation is classified according to a hearing situation at any one time, the sound of the hearing aid is stored, and subsequently the sound setting with the assigned classification is stored. In this case, the sound setting is automatically stored with the associated classification after each adjustment.

8 Claims, 2 Drawing Sheets

HEARING AID WITH AUTOMATIC SOUND STORAGE AND CORRESPONDING METHOD

BACKGROUND

The present invention relates to a hearing aid with a classification device for classifying a hearing situation at any one time, a setting device for setting the sound of the hearing aid, and a memory device, which is connected to the classification device and the setting device, for storing a sound setting with the assigned classification. In addition, the present invention relates to a corresponding method for operating a hearing aid.

The individually preferred sound settings of a hearing aid are dependent on the acoustic surroundings. For example, higher levels are desired for music at low frequencies than when holding a conversation in noisy surroundings. This means that the sound setting is generally carried out according to the signal class.

Modern hearing aids have classification systems which sense the hearing situation at any one time and perform corresponding settings in the hearing aid. These settings are determined during an adapting session with an acoustician and entered in the hearing aid as a fixed setting. From this fixed setting, the wearer of the hearing aid can then manually perform changes of the sound settings corresponding to changed acoustic requirements in each case from the fixed setting for the respective hearing situation. To avoid constant resetting, readjustment with the acoustician is necessary.

European Patent EP 0 814 634 B1 discloses a programmable hearing aid system. In this case, the set of parameters of a programmable hearing aid assigned to each hearing situation is not already established during adaptation with the hearing aid acoustician, but instead a number of test parameter sets are provided at the beginning for each hearing situation. In an optimizing phase, the wearer of the hearing aid can then determine which set of parameters is individually best suited for him in the individual hearing situations. The set of parameters is finally permanently assigned to the hearing situation. This constitutes adaptation to actual acoustic surrounding conditions, which can largely be performed by the wearer of the hearing aid himself.

In addition, the German patent document DE 101 52 197 A1 describes a method for programming a hearing aid with the aid of a remote control. The wearer of the hearing aid can switch his hearing aid to a receiving mode, in which absolute or relative parameter changes concerning the volume, high- or low-frequency boosting, activation of a noise filter, etc., are recorded. Recording is ended by actuating a memory button and stored in the hearing aid or the remote control. If the hearing aid then detects the same hearing situation once again, not only the setting for the hearing program provided for this but also the previously recorded operating steps become effective, so that an individual adaptation of the hearing program to the respective surrounding situation takes place.

The European patent document EP 1 453 356 A2 also discloses a method for setting a hearing system, it being possible for interactive adaptation to be performed during operation. A classifier detects different hearing situations and starts interactive adapting procedures, within which various settings must be assessed. In this case, only settings which match the hearing situation are offered.

SUMMARY

The object of the present invention is to make the individual adaptation of a hearing aid more convenient.

This object is achieved according to various embodiments of the invention by a hearing aid with a classification device for classifying a hearing situation at any one time, a setting device for setting the sound of the hearing aid, and a storage device, which is connected to the classification device and the setting device, for storing a sound setting with the assigned classification, it being possible for a sound setting to be automatically stored in the storage device with the associated classification after each setting.

Also provided according to various embodiments of the invention is a method for operating a hearing aid by classifying a hearing situation at any one time, setting the sound of the hearing aid, and storing a sound setting with the assigned classification, a sound setting being automatically stored with the associated classification after each adjustment.

Such a hearing aid is therefore constantly in a learning mode, the last changes/settings performed by the user always being stored in the latest hearing program. The settings are then taken over once again when the hearing aid is switched again into this program.

The setting device preferably comprises a remote control. This ensures more convenient operation of the hearing aid. With the remote control, the sound of the hearing aid can preferably also be set for the hearing situation at any one time.

According to a preferred embodiment, the classification device can be used to switch automatically into a signal class corresponding to the hearing situation at any one time, with the associated sound setting. With the automatic storage of the sound setting, it is not only retained in the last chosen state when the hearing aid is switched on and off but also when there is an automatic change of the hearing program according to the respective signal class.

With the automatic switching-over of the hearing program, in a preferred embodiment, there is cross-fading from a first sound setting into a second sound setting. This has the advantage that the wearer of the hearing aid is not surprised by a high volume if a specific frequency band in the newly switched-on hearing program is amplified to a much higher level than in the old hearing program.

DETAILED DESCRIPTION OF THE PREFERRED EMBODIMENTS

Figure 1:
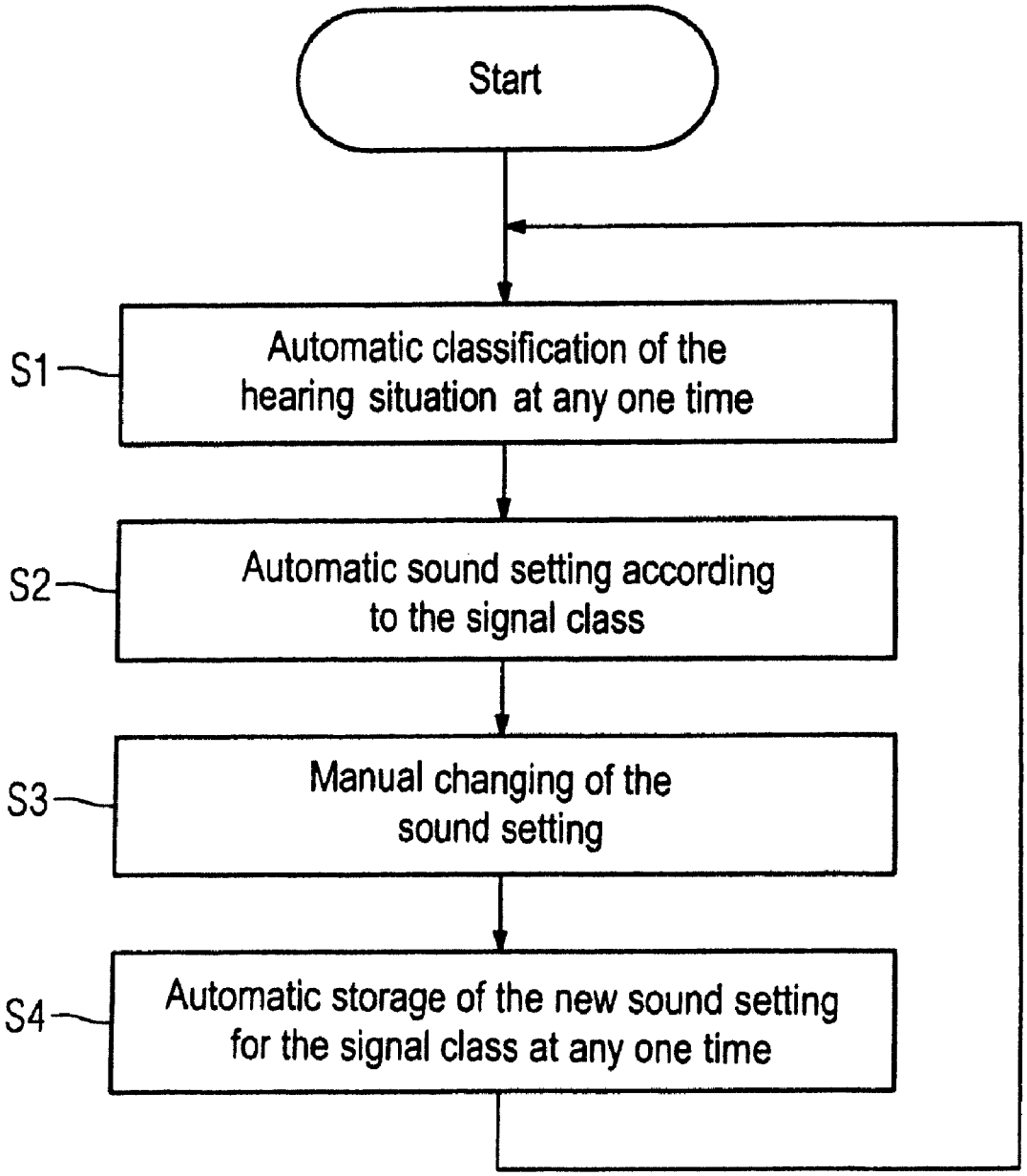
FIG. 1. shows a flowchart of the way in which the hearing aid is set according to an embodiment of the invention.
Figure 2:
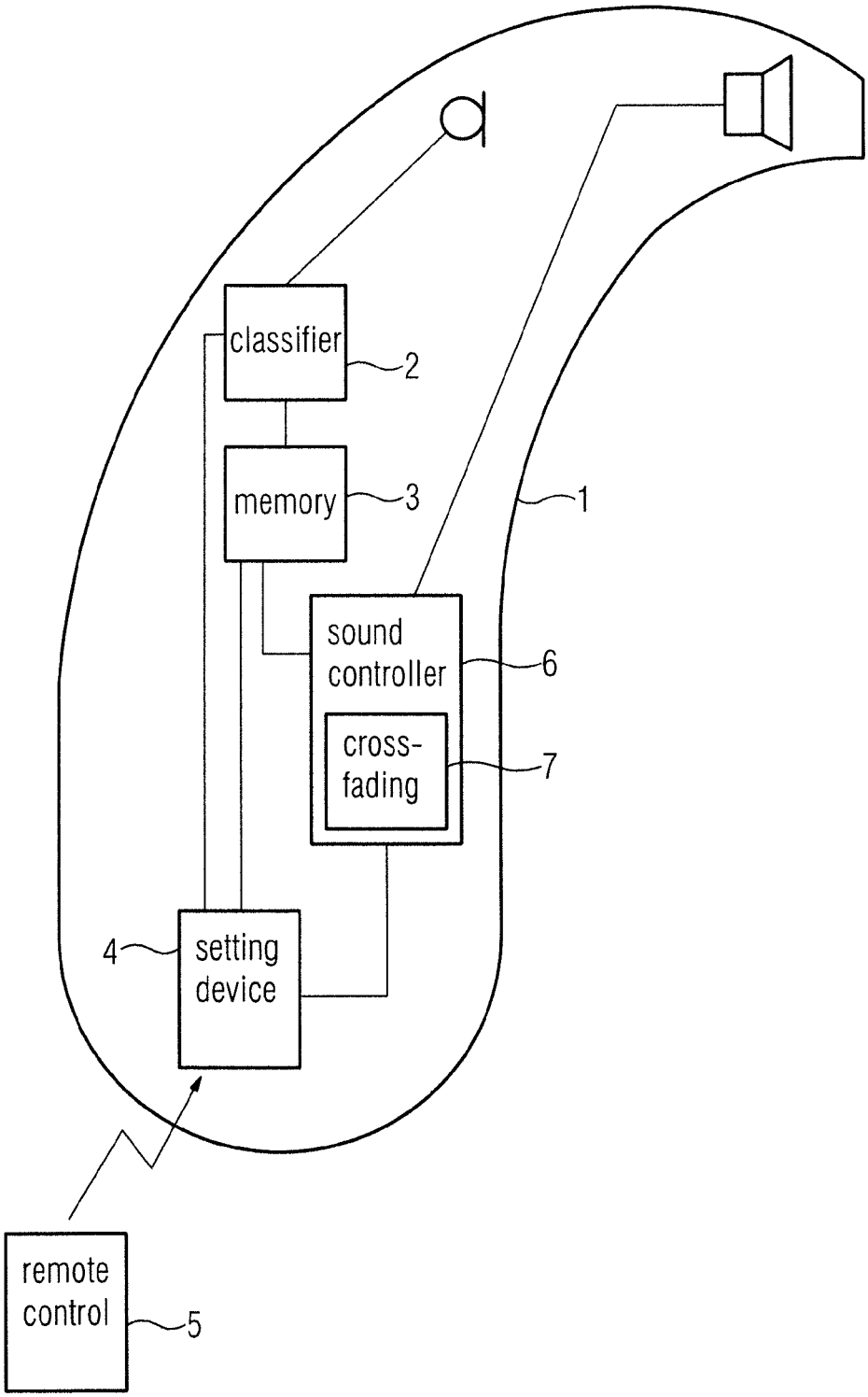
FIG. 2 is a block diagram of an embodiment of a hearing aid in accordance with the present invention.

The exemplary embodiment described below represents a preferred embodiment of the present invention. According to the flowchart represented in FIG. 1, after switching on the hearing aid 1 (see FIG. 2) or starting, an automatic classification of the hearing situation that exists at any given time takes place, corresponding to step S1, with the classification device 2 of the hearing aid 1. The hearing aid 1 uses this classification information to load the sound setting corresponding to the classification information automatically from a memory 3, as indicated in step S2.

The hearing aid system has a setting device 4 which makes it possible to set the sound during day-to-day operation. In the present example, the setting device 4 is realized by a remote control 5, although any known control mechanism may be utilized. The wearer of the hearing aid 1 therefore uses the buttons on the remote control 4 for the sound setting. This sends information on the adjustment of the sound controller 6 wirelessly to the hearing aid 1.

In the hearing aid, the hearing situation at any given time has already been sensed with the aid of the classification device 2, corresponding to step S1, so that the change in sound can be assigned to the detected class. The new sound setting is then stored in the memory 3, corresponding to step S4, for the signal class in which the hearing aid is operating at the time the setting was made via the remote control.

The memory 3 of the hearing aid 1 contains a number of sound settings for each signal class and for each hearing aid program. If the hearing situation changes, the corresponding sound setting is automatically called up from the memory 3 and set, corresponding to S1 to S4. The transition of the sound setting takes place by slow cross-fading 7.

To make the setting of a multi-program hearing aid even more convenient, the sound settings are synchronized in a suitable way between the hearing programs. In other words, a setting for speech in quiet conditions, for example, is transferred into a fixed program for quiet surroundings in an automatic program. Consequently, the wearer of the hearing aid does not have to carry out the same sound setting in all hearing programs for similar hearing situations.

It is consequently ensured according to the invention that the wearer of the hearing aid can conveniently adjust the sound of his aid and adapt it to the hearing situation at any one time. The hearing aid then stores the settings automatically, so that the wearer of the hearing aid does not have to perform the settings again after switching over or switching off the aid. The hearing aid therefore always remembers the respective setting and is virtually always in a learning mode. It goes without saying that the hearing aid may also be provided with the option of switching off the learning mode.

According to the invention, it is consequently possible for long-term acclimatization effects, changing typical acoustic surroundings and changing hearing loss of the user to be allowed for in the settings by the user himself, without having to visit the acoustician.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, where the elements of the present invention are implemented using software programming or software elements the invention may be implemented with any programming or scripting language such as C, C++, Java, assembler, or the like, with the various algorithms being implemented with any combination of data structures, objects, processes, routines or other programming elements. Furthermore, the present invention could employ any number of conventional techniques for electronics configuration, signal processing and/or control, data processing and the like.

The particular implementations shown and described herein are illustrative examples of the invention and are not intended to otherwise limit the scope of the invention in any way. For the sake of brevity, conventional electronics, control systems, software development and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A hearing aid comprising:

a classification device that automatically detects a hearing situation that currently exists in an environment in which the hearing aid is currently located, and that assigns a class, from among a plurality of different hearing situation classes, to the hearing situation that currently exists;

a memory in which a plurality of different assigned settings are stored respectively associated with the plurality of different classes of hearing situations, each setting comprising operating parameters for the hearing aid that cause the hearing aid to emit sound appropriate for the associated class of hearing situation;

a setting device in communication with said classification device and said memory, said setting device being configured, in response to being supplied with the class of the current hearing situation by said classification device, to automatically access said memory and to retrieve therefrom the assigned setting associated with the class of the current hearing situation;

a manual input device in communication with said setting device configured to allow manual entry of a manual setting of operating parameters for the class of said current hearing situation; and said setting device, in response to said manual entry, being configured to access said memory and replace the assigned setting for said class of said current hearing situation with said manual setting and to thereafter retrieve said manual setting when said class of said current hearing situation is detected by said classification device.

2. The hearing aid as claimed in claim 1 wherein said manual input device is a remote control unit in remote communication with said setting device.

3. The hearing aid as claimed in claim 1 wherein said manual input device is a switch that is located at an exterior of a housing of said hearing aid.

4. The hearing aid as claimed in claim 1 comprising a cross-fading circuit connected to said setting device that cross fades from said class of said current hearing situation to a class of a further hearing situation, when said further hearing situation is detected in said environment by said classification device.

5. A method for operating a hearing aid comprising the steps of:

with a classification device in a hearing aid, automatically detecting a hearing situation that currently exists in an environment in which the hearing aid is currently located, and assigning a class, from among a plurality of different hearing situation classes, to the hearing situation that currently exists;

electronically storing in a memory a plurality of different assigned settings respectively associated with the plurality of different classes of hearing situations, each setting comprising operating parameters for the hearing aid that cause the hearing aid to emit sound appropriate for the associated class of hearing situation;

from a setting device in communication with said classification device and said memory, automatically accessing, in response to being supplied with the class of the current hearing situation by said classification device, said memory and retrieving therefrom the assigned setting associated with the class of the current hearing situation;

placing a manual input device in communication with said setting device and from said manual input device entering a manual setting of operating parameters for the class of said current hearing situation; and from said setting device, in response to entry of said manual setting, accessing said memory and replacing the assigned setting for said class of said current hearing situation with said manual setting and thereafter retrieving said manual setting when said class of said current hearing situation is detected by said classification device.

6. The method as claimed in claim 5 comprising making said manual setting from a remote control unit in remote communication with said setting device.

7. The method as claimed in claim 5 comprising making said manual setting with a switch that is located at an exterior of a housing of said hearing aid.

8. The method as claimed in claim 5 comprising a cross-fading in said hearing aid from said class of said current hearing situation to a class of a further hearing situation, when said further hearing situation is detected in said environment by said classification device.

* * * * *